US009636731B2

(12) United States Patent
Yamamoto

(10) Patent No.: US 9,636,731 B2
(45) Date of Patent: May 2, 2017

(54) METHOD AND APPARATUS FOR MOLDING METAL LAMINATE FILM

(71) Applicant: Panasonic Corporation, Kadoma-shi, Osaka (JP)

(72) Inventor: Hideo Yamamoto, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 1191 days.

(21) Appl. No.: 13/687,793

(22) Filed: Nov. 28, 2012

(65) Prior Publication Data

US 2013/0243548 A1 Sep. 19, 2013

(30) Foreign Application Priority Data

Mar. 13, 2012 (JP) ..... 2012-055197

(51) Int. Cl.

| | |
|---|---|
| ***B21D 5/16*** | (2006.01) |
| ***B21D 22/20*** | (2006.01) |
| ***B21D 11/18*** | (2006.01) |
| ***B21D 26/027*** | (2011.01) |
| ***B21D 26/053*** | (2011.01) |

(Continued)

(52) U.S. Cl.

CPC ..... *B21D 5/16* (2013.01); *B21D 11/18* (2013.01); *B21D 22/203* (2013.01); *B21D 22/208* (2013.01); *B21D 26/027* (2013.01); *B21D 26/053* (2013.01); *B21D 28/10* (2013.01); *B65B 3/022* (2013.01)

(58) Field of Classification Search

CPC .... B21D 22/208; B21D 26/02; B21D 26/021; B21D 24/02; B21D 22/205; B21D 5/16; B21D 11/18; B21D 26/027; B21D 26/053; B21D 22/203; B21D 28/10; B65B 3/022

See application file for complete search history.

(56) References Cited

U.S. PATENT DOCUMENTS

| | | | |
|---|---|---|---|
| 4,644,626 | A | 2/1987 | Barnes et al. |
| 4,851,178 | A | 7/1989 | Wendt |

(Continued)

FOREIGN PATENT DOCUMENTS

| | | |
|---|---|---|
| CN | 1082983 | 3/1994 |
| CN | 1358130 | 7/2002 |

(Continued)

OTHER PUBLICATIONS

Translation of DE10027079A1 from ESPACENET http://translationportal.epo.org/emtp/translate/?ACTION=description-retrieval&COUNTRY=DE&ENGINE=google&FORMAT=docdb&KIND=A1&LOCALE=en_EP&NUMBER=10027079&OPS=ops.epo.org/3.1&SRCLANG=de&TRGLANG=en.*

*Primary Examiner* — David Bryant
*Assistant Examiner* — Pradeep C Battula
(74) *Attorney, Agent, or Firm* — Hamre, Schumann, Mueller & Larson, P.C.

(57) ABSTRACT

A punch (2) and a pad (5) are opposed to each other such that a molded portion (3*a*) of a metal laminate film (3) to be processed is interposed between the punch (2) and the pad (5). An enclosed space (6, 7) is compressed to raise only the temperature of the molded portion (3*a*) while keeping the vicinity of the molded portion (3*a*) at a low temperature (S1, S2). After that, the enclosed space (6, 7) is moved with respect to the molded portion (3*a*) to perform first molding (S3) on the molded portion (3*a*), and then gas in the enclosed space (6) is released to perform second molding (S4) on the (Continued)

molded portion (3*a*) by means of the punch (2) and the pad (5).

1 Claim, 13 Drawing Sheets

(51) Int. Cl.
*B21D 28/10* (2006.01)
*B65B 3/02* (2006.01)

(56) References Cited

U.S. PATENT DOCUMENTS 5,081,859 A * 1/1992 De Smet ..... B21D 22/10 29/421.1
5,689,987 A * 11/1997 Yasui ..... B21D 26/055 72/20.1
5,987,957 A * 11/1999 Foeller ..... B29C 51/14 156/196
6,835,348 B2 12/2004 Hirosue et al.
7,878,040 B2 2/2011 Taya et al.
2003/0140672 A1 7/2003 Gruszka et al.

FOREIGN PATENT DOCUMENTS

CN 1672900 9/2005
CN 101031373 B 10/2010
DE 10027079 A1 * 12/2001 ..... B21D 22/205
JP 61-123421 6/1986
JP 3-124328 5/1991
JP 5-50498 3/1993
JP 11-290960 10/1999
JP 2002-178046 6/2002
JP 2003-53438 2/2003

* cited by examiner

METHOD AND APPARATUS FOR MOLDING METAL LAMINATE FILM

FIELD OF THE INVENTION

The present invention relates to a method and apparatus for molding a metal laminate film into a film package.

BACKGROUND OF THE INVENTION

In recent years, packaging materials and containers have been manufactured by molding metal laminate films. A metal laminate film includes a resin layer (containing polyamide, polypropylene, and PET) laminated on a metal thin film (containing aluminum, copper, and iron). A technique for molding such a metal laminate film is also applied to a processing technique of manufacturing packages for non-aqueous electrolytic secondary batteries and packages for other secondary battery packages.

When a metal laminate film as a material is molded into a deep shape, the metal laminate film may have breaks or slightly or considerably wavy wrinkles on or around a molded portion.

Such breaks may expose an interior product to an external environment, interfering with the protective function of a package. Moreover, such wrinkles may spoil the appearance of the package and have a repeated stress concentration caused by frictions with the external environment, temperature changes, and so on. Thus, fatigues are accumulated with the passage of time so as to accelerate breaks on the film. For this reason, there is a need for a method for molding a metal laminate film so as to simultaneously suppress breaks and wrinkles.

FIG. 12 illustrates a conventional technique for attaining the object.

FIG. 12(*a*) is a cross-sectional view illustrating an assembly of a cope and a drag. FIG. 13(*a*) is a plan view of the cope taken along line A1-A1 of FIG. 12(*a*). FIG. 13(*b*) is a plan view of the drag taken along line A2-A2 of FIG. 12(*a*). A die 1 serving as the drag has a die hole 1*a*. The cope includes a punch 2, a plate 4, and an elastic body 51.

In the technique illustrated in FIGS. 12(*a*) and 12(*b*), the die 1, the plate 4, and the elastic body 51 apply a pressure to an area 3*b* surrounding a metal-laminate-film molded portion of a metal laminate film 3, which is a workpiece. The die 1 is opposed to the punch 2 while the plate 4 and the elastic body 51 are provided around the punch 2.

In this configuration, a pressure applied to the metal laminate film 3 by the elastic body 51 is smaller than a pressure to the plate 4. A pressure applied to the metal laminate film 3 by the plate 4 is set so as to completely fix the metal laminate film 3 on the top surface of the die 1. Thus, the metal laminate film 3 pressed by the elastic body 51 and the plate 4 is molded into a desired shape by pressing the punch 2 into the die 1. In this case, the elastic body 51 applies a proper pressure to the metal laminate film 3, thereby suppressing the occurrence of wrinkles while accelerating a flow of material into a molded portion 3*a*.

CITATION LIST

Patent Literature

[Patent Literature 1]
Japanese Patent Laid-Open No. 2002-178046

DISCLOSURE OF THE INVENTION

In response to an increasing variety of products in recent years, however, there is an increasing demand for a technique of molding film packages into deeper molded shapes or complicated rough shapes.

Since a molding depth limit is low in the conventional technique, products requiring deep molded shapes may be broken.

Although the conventional technique can reduce wrinkles around a molded portion, mainly small wrinkles, considerably wavy wrinkles may be left on the molded portion 3*a*. Such wavy wrinkles are caused by a phenomenon in which resin layers on two surfaces of the molded metal laminate film return to pre-molding lengths (spring back). Spring back on a complicated molded shape may accumulate a residual stress in the metal thin film and the resin layers, leading to distortion and deformation observed as wrinkles.

As a solution to this problem, a molding technique is available in which a metal laminate film and dies are increased in temperature before molding, and then the film and the dies are cooled again. In this technique, the molecular structure of a resin layer on the surface of the metal laminate film is fixed so as to stabilize plastic deformation and reduce the spring back of a material, thereby suppressing wrinkles. Since the overall metal laminate film is raised in temperature, a coefficient of friction with the punch 2 of the resin layer increases on two surfaces of the metal laminate film, interfering with a flow of material from the vicinity of the molded portion 3*a* into the molded portion 3*a*. Hence, breaks are more likely to occur than in the conventional technique.

An object of the present invention is to provide a method for molding a metal laminate film, which can improve the extensibility of a material, reduce spring back, and suppress breaks or wrinkles on a metal laminate film, thereby protecting a packaged product for an extended period and improving the appearance of a package.

A method for molding a metal laminate film according to the present invention includes the steps of: raising the temperature of the molded portion of a metal laminate film to be processed, by compressing an enclosed space locally formed on the molded portion; first molding for molding the molded portion by moving the compressed enclosed space with respect to the molded portion; and second molding for molding and cooling the molded portion interposed between a punch and a pad. Specifically, the method includes the steps of: raising the temperature of the molded portion of a metal laminate film to be processed, by compressing a first enclosed space and a second enclosed space, the first enclosed space being locally formed on the top surface of the molded portion by a punch and a pad opposed to each other with the molded portion interposed between the punch and the pad, the second enclosed space being locally formed on the bottom of the molded portion; first molding for molding the molded portion by moving the compressed enclosed spaces with respect to the molded portion; and second molding for molding and cooling the molded portion by releasing gas in the first enclosed space to press the molded portion to the pad by means of the punch.

An apparatus for molding a metal laminate film according to the present invention includes: a punch; a die opposed to the punch such that the molded portion of a metal laminate film to be processed is interposed between the punch and the die; a plate provided around the punch to press the molded portion with the die; and a pad provided in the die, wherein the punch has a first hole connecting a first enclosed space to the outside, the first enclosed space being formed between the molded portion and the punch, the apparatus further includes an operation control unit, and the operation control unit operates the punch and the pad to form the first enclosed space surrounded by the punch, the plate, and the molded portion and a second enclosed space surrounded by the die and the molded portion, presses the first and second enclosed spaces to increase the temperature of the molded portion, performs first molding on the molded portion by moving the first and second enclosed spaces with respect to the molded portion, and performs second molding and cooling on the molded portion by releasing gas from the first enclosed space through the first hole to press the molded portion to the pad by means of the punch.

A method for molding a metal laminate film according to the present invention includes the steps of: raising the temperature of the molded portion of a metal laminate film to be processed, by compressing a first enclosed space and a second enclosed space, the first enclosed space being locally formed on the top surface of the molded portion by a punch and a pad opposed to each other with the molded portion interposed between the punch and the pad, the second enclosed space being locally formed on the bottom of the molded portion; first molding for molding the molded portion of the metal laminate film by moving the compressed first and second enclosed spaces with respect to the molded portion while releasing gas from the second enclosed space; and second molding for molding and cooling the molded portion by releasing gas from the first enclosed space to press the molded portion to the pad by means of the punch.

An apparatus for molding a metal laminate film according to the present invention includes: a punch; a die opposed to the punch such that the molded portion of a metal laminate film to be processed is interposed between the punch and the die; a plate provided around the punch to press the metal laminate film with the die; and a pad provided in the die, wherein the punch has a first hole connecting a first enclosed space to the outside, the first enclosed space being formed between the molded portion and the punch, the die has a second hole connecting a second enclosed space to the outside in a state in which the pad has moved to a specified position in a direction of separating from the punch, the second enclosed space being surrounded by the die, the molded portion, and the pad, the apparatus further includes an operation control unit, and the operation control unit operates the punch and the pad to increase the temperature of the molded portion by pressing the first and second enclosed spaces in a state in which the first hole is closed and the pad is moved to a position that closes the second hole, performs first molding on the molded portion by moving the first and second enclosed spaces with respect to the molded portion, and performs second molding and cooling on the molded portion by moving the pad to a position that opens the second hole and releasing gas from the first enclosed space through the first hole to press the molded portion to the pad by means of the punch.

A method for molding a metal laminate film according to the present invention includes the steps of: raising the temperature of the molded portion of a metal laminate film to be processed, by compressing a first enclosed space locally formed on the top surface of the molded potion by the punch of a cope and a pad inside the die of a drag, the punch and the pad being opposed to each other with the molded portion interposed between the punch and the pad; first molding including primary molding on the molded portion, the primary molding including the step of moving the punch to the pad to press the first enclosed space while partially pressing the pad, which has been pressed upward close to the punch by a spring, by means of the end of a pin to move the pad against the urging force of the spring, the pin being connected to the cope at the proximal end of the pin, the primary molding being completed when the pad reaching a molding depth is stopped at the bottom dead center by the action of a cam mechanism; and second molding performed on the molded portion by further moving the punch to the pad while releasing gas from the first enclosed space to mold the molded portion by means of the punch, the die, and the pad.

An apparatus for molding a metal laminate film according to the present invention includes: a punch attached to a cope; a die provided on a drag; a pad that is partially provided in the die and is urged to the punch by a spring; a plate provided around the punch; a cam mechanism that temporarily stops the pad at the bottom dead center; a pin connected to the cope at the proximal end of the pin to simultaneously move the punch and the pad; and an operation control unit, wherein the operation control unit raises the temperature of the molded portion of a metal laminate film to be processed, by moving the punch to the pad to compress a first enclosed space locally formed on the top surface of the molded portion, the punch being opposed to the pad with the molded portion interposed between the punch and the pad, the operation control unit performs primary molding on the molded portion by pressing the pad, which has been pressed upward close to the punch by the spring, by means of the end of the pin to move the pad against the urging force of the spring, the primary molding being completed when the pad reaching a molding depth is stopped at the bottom dead center by the action of the cam mechanism, and the operation control unit performs secondary molding on the molded portion by further moving the punch to the pad while releasing gas from the first enclosed space to mold and cool the molded portion by means of the punch, the die, and the pad.

According to the present invention, during the molding of the metal laminate film, only the temperature of the molded portion can be raised while the vicinity of the molded portion is kept at a low temperature. Thus, without interfering with a flow of material from the vicinity of the molded portion to the molded portion, the present invention can improve the extensibility of the material, reduce spring back, and suppress breaks or wrinkles on the metal laminate film, thereby protecting a packaged product for an extended period to improve the product quality and improving the appearance of a package.

BRIEF DESCRIPTION OF THE DRAWINGS

FIG. 5(*b*) is a plan view illustrating the drag of the molding apparatus used for the second embodiment;

FIG. 9(*b*) is a plan view illustrating the drag of the molding apparatus used for the third embodiment;

FIG. 12(*b*) is a cross-sectional view illustrating a metal laminate film pressed to a molded portion by a punch;

FIG. 13(*b*) is a plan view of the drag taken along line A2-A2 of the conventional technique.

DESCRIPTION OF THE EMBODIMENTS

A method for molding a metal laminate film according to the present invention will be described below according to specific embodiments.

First Embodiment

Figure 1:
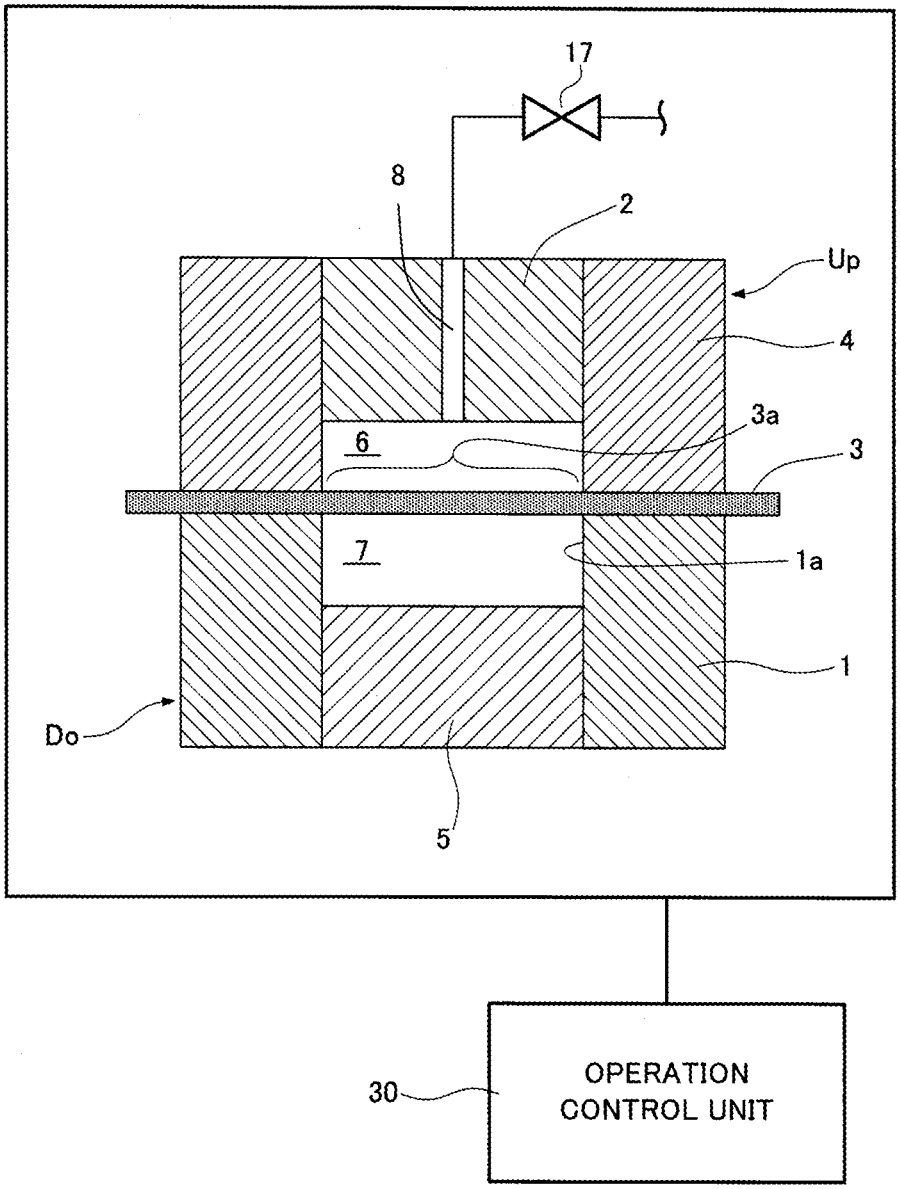
FIG. 1 is a cross-sectional view illustrating a molding apparatus according to a first embodiment, the molding apparatus being used for a method for molding a metal laminate film according to the present invention.
Figure 2:
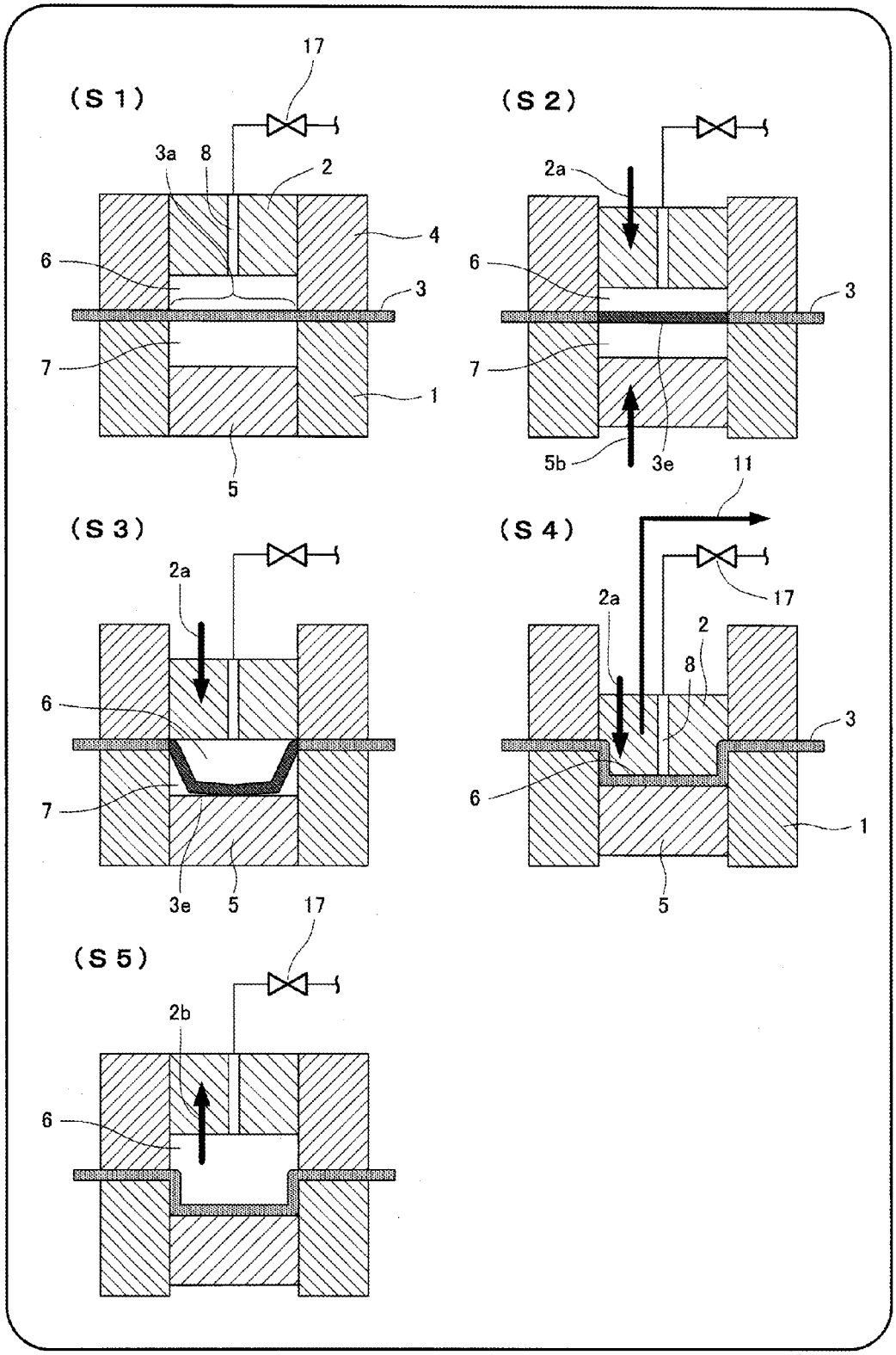
FIG. 2 is a molding process drawing of the molding apparatus according to the first embodiment.
Figure 3:
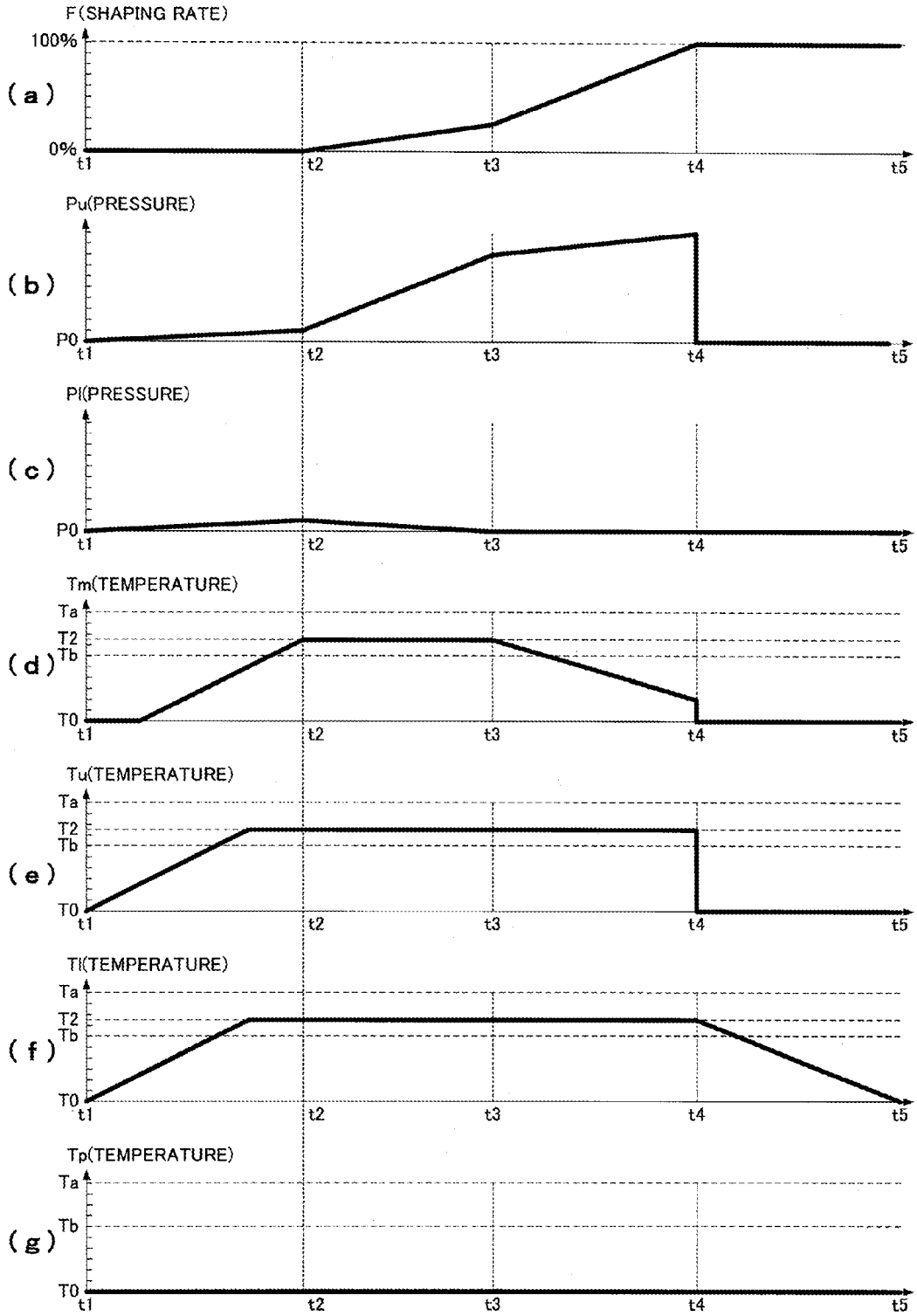
FIG. 3 is a change chart showing a pressure, a temperature, and so on of each part in the steps of the first embodiment.

FIGS. 1 to 3 show a first embodiment of the present invention.

As illustrated in FIG. 1, in an apparatus for molding a metal laminate film, a drag Do includes a die 1 and a pad 5 provided on a die hole 1*a*. A cope Up includes a punch 2 that is opposed to the die 1 with a certain clearance so as to sandwich a metal laminate film (hereinafter, will be referred to as a film) 3 between the punch 2 and the die 1, and a plate 4 that is attached around the punch 2. The punch 2 has a first hole 8 that releases air into the atmosphere. The first hole 8 is opened or closed by, for example, a valve 17 to control a flow of air. An operation control unit 30 controls the operations of the drag Do, the cope Up, the punch 2, the pad 5, and so on.

The film 3 is a molded laminate of a centered metal thin film (containing aluminum, copper, iron, and so on) and resin layers (containing polyamide, polypropylene, PET, and so on) provided on two surfaces of the metal thin film.

A first enclosed space 6 surrounded by the punch 2, the plate 4, and the film 3 is formed on a molded portion 3*a*. A second enclosed space 7 surrounded by the die 1, the pad 5, and the film 3 is formed under the molded portion 3*a*.

Steps S1 to S5 illustrate a molding process performed by the operation control unit 30. FIG. 3 shows time variations in the shaping rate, pressure, and temperature of a molded article in each step. A shaping rate F of the molded article is defined as the total of migrations of material atoms/the total of migrations at the completion of the molded article. The initial shape is defined as 0% and the completion of the molded article is defined as 100%.

In the graphs of FIGS. 3(*a*) to 3(*g*), t1 to t5 on the horizontal axes represent the following times:

t1: the completion of enclosed space formation in step S1 of FIG. 2;

t2: the completion of temperature rise in step S2;

t3: the completion of first molding in step S3;

t4: the completion of second molding in step S4;

t5: the completion of return in step S5. The vertical axes in FIGS. 3(*a*) to 3(*g*) represent the following:

Pu: a pressure in the first enclosed space 6;

Pl: a pressure in the second enclosed space 7;

Tm: the mean temperature of the molded portion 3*a;*

Tu: a temperature in the first enclosed space 6;

Tl: a temperature in the second enclosed space 7

Tp: temperatures on the punch 2, the die 1, the pad 5, and the plate 4.

In the operations of the present embodiment, the temperature of the film 3 or the temperature of air in the first and second enclosed spaces 6 and 7 is increased, and then the film 3 and the spaces 6 and 7 are cooled. In the case where one of the resin layers on two surfaces of the film 3 has a higher melting temperature Ta, the other resin layer has a lower melting temperature Tb, and an outside air temperature is T0 (Ta>Tb>T0), a temperature Ts on the film 3 or in the air of the first and second enclosed spaces 6 and 7 is defined as an elevated temperature state when Ts satisfies Ta>Ts>Tb, whereas Ts=T0 is defined as a cooled state.

First, in the enclosed space formation of step S1, the first enclosed space 6 surrounded by the punch 2, the plate 4, and the film 3 is formed on the molded portion 3*a* while the second enclosed space 7 surrounded by the die 1, the pad 5, and the film 3 is formed under the molded portion 3*a*. At this point, the film 3 is pressed by the plate 4 and the die 1 with a certain pressure. In this step, the shaping rate F is 0%, Pu=Pl=P0 (atmospheric pressure) is satisfied, and Tm=Tu=Tl=Tp=T0 (room temperature) is satisfied. The film 3 in the molded portion 3*a* is cooled.

In the temperature rise of step S2, the punch 2 moves down along an arrow 2*a* and the pad 5*b* moves up to compress air in the first and second enclosed spaces 6 and 7, placing the molded portion 3*a* into an elevated temperature state 3*e*. In the case where one of the resin layers on the two surfaces of the film 3 has the higher melting temperature Ta and the other resin layer has the lower melting temperature Tb, the temperatures Tu and Tl of the first and second enclosed spaces 6 and 7 are set as Tu=Tl=T2 and Ta>T2>Tb. Thus, the mean temperature Tm of the molded portion 3*a* also rises to T2.

In the first molding of step S3, the punch 2 moves down along the arrow 2*a* to increase an air pressure in the first enclosed space 6; meanwhile, the operation of the pad 5 is stopped to make a pressure difference from the second enclosed space 7, completing primary molding to a preformed shape. The pressure Pu in the first enclosed space 6, the pressure Pl in the second enclosed space 7 (Pu>Pl), and a pressure difference Pa required for the primary molding are set to satisfy (Pu−Pl)>Pa. In this step, the shaping rate F is about 20% to 90%.

In the second molding of step S4, the punch 2 further moves down along the arrow 2*a* to punch the film 3 by means of the punch 2, the die 1, and the pad 5. At this point, as shown in FIG. 3(*g*), the punch 2, the die 1, and the pad 5 are kept cooled (temperature T0). Thus, the film 3 raised at the temperature T2 (Ta>T2>Tb) at time t3 comes into contact with the punch 2, the die 1, and the pad 5 having low temperatures at time t4, so that the film 3 is cooled to the temperature T0.

When the punch 2 reaches the bottom dead center, the valve 17 is opened to pass high temperature and high pressure air in the first enclosed space 6 to the outside of the first enclosed space 6 (along an arrow 11) through the first hole 8. The cooling period of the film 3 is shortened by opening the valve 17.

Finally, in the return of step S5, the punch 2 is moved up along an arrow 2*b* with the opened valve 17 to the point of origin while releasing the air of the first enclosed space 6.

These steps can suppress breaks on the molded article.

Specifically, in step S2, only the molded portion 3*a* is locally placed into the elevated temperature state 3*e*, increasing the extensibility of the material of the molded portion 3*a*.

Furthermore, in the first molding of step S3, the molded portion 3*a* sandwiched by the punch 2 and the pad 5 undergoes the primary molding into the preformed shape so as to extend the overall material before second molding. Thus, the material in the molded portion 3*a* can be evenly extended.

In the punching of step S4, the molded portion 3*a* is kept in the elevated temperature state 3*e* for a short time after the punch 2 comes into contact with the film 3, causing high friction resistance between the punch 2 and the film 3. The friction force can accelerate a flow of material into the molded portion from the vicinity of the molded portion. Additionally, an area other than the molded portion 3*a* can be kept cooled between the die 1 and the plate 4 so as to have a smaller friction force, thereby accelerating a flow of material into the molded portion 3*a*.

Moreover, in step S4, the film 3 raised in temperature is cooled again in contact with the punch 2 after punching, the molecular structures of the resin layers on the surfaces of the film 3 are fixed so as to stabilize plastic deformation and reduce the spring back of the material, thereby suppressing wrinkles in the molded portion 3*a*.

Furthermore, in the present embodiment, the punch 2 directly comes into contact with the film 3 in the molded portion 3*a* to cool the film 3, thereby shortening a cooling time and a molding cycle.

Moreover, the film 3 raised in temperature can be cooled at the completion of the molded shape, thereby preventing a change of the molded shape and reducing variations in shape.

Second Embodiment

FIGS. 4 to 7 illustrate a second embodiment according to the present invention.

The same configurations as in the first embodiment will be indicated by the same reference numerals.

Figure 4:
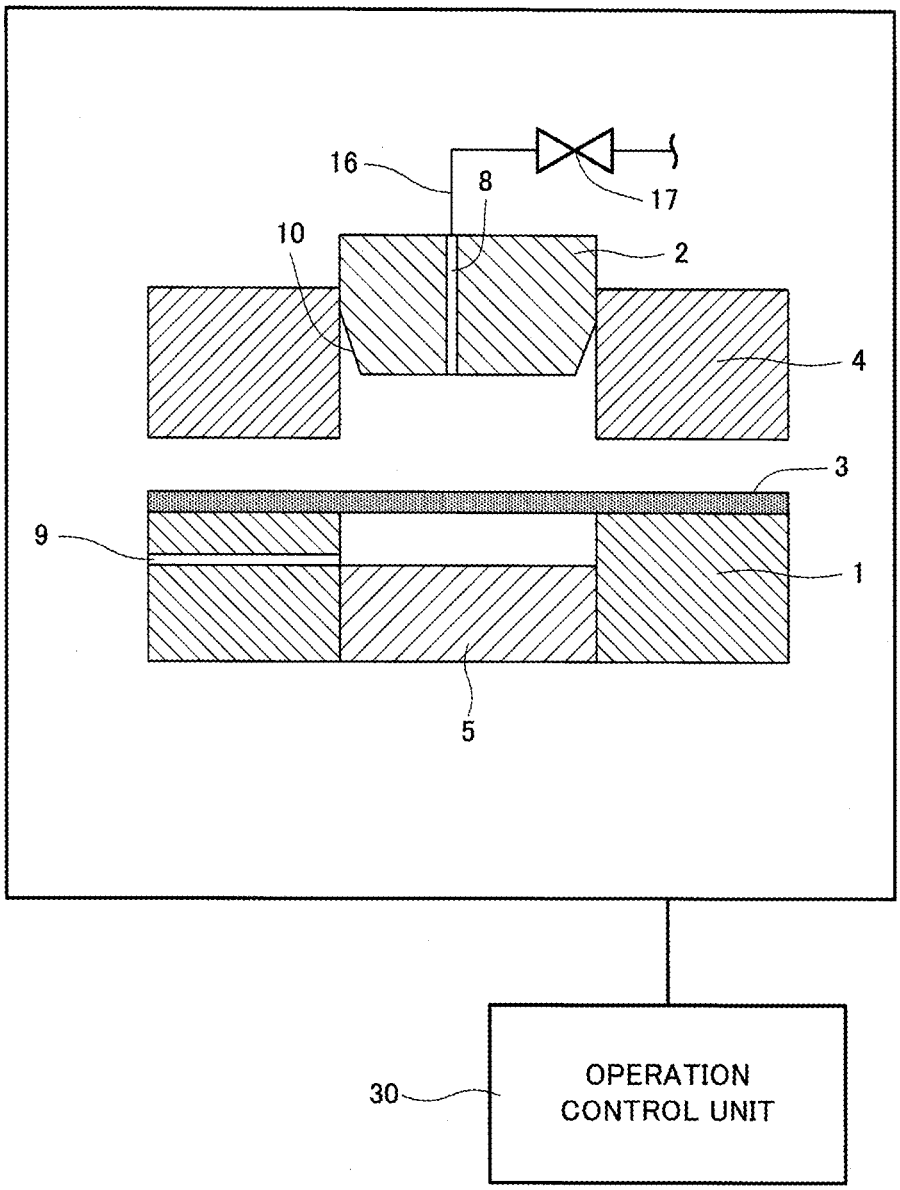
FIG. 4 is a cross-sectional view illustrating a molding apparatus according to a second embodiment, the molding apparatus being used for a method for molding a metal laminate film according to the present invention.
Figure 5:
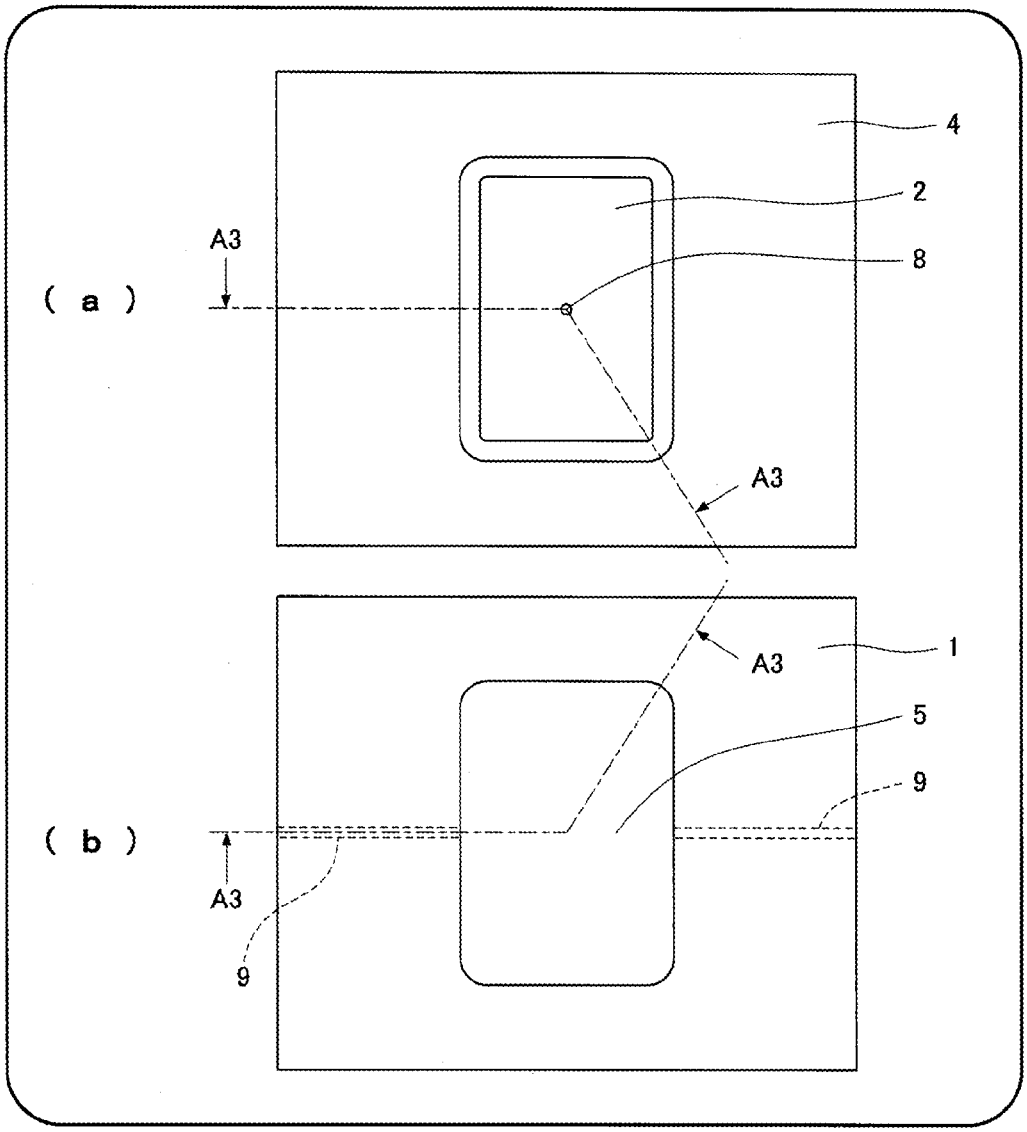
FIG. 5(*a*) is a plan view illustrating the cope of the molding apparatus used for the second embodiment.

FIG. 4 is a cross-sectional view illustrating an apparatus for molding a metal laminate film. In FIG. 4, a cope Up and a drag Do in FIGS. 5(*a*) and 5(*b*) are cut along line A3-A3.

The drag Do includes a die 1 and a pad 5 provided in a die hole 1*a*. The die 1 includes a second hole 9 that is set at a molding depth from the top surface of the die 1 such that the die hole 1*a* communicates with the outside.

The cope Up includes a punch 2 that is opposed to the die 1 with a certain clearance so as to sandwich a film 3 between the punch 2 and the die 1, and a plate 4 that is attached around the punch 2. The punch 2 has a first hole 8 that releases air into the atmosphere. The first hole 8 is opened or closed by, for example, a valve 17 to control a flow of air.

In this configuration, the punch 2 moves down to mold the film 3, which has a thickness of 50 μm to 500 μm on the die 1, into a predetermined molded shape. Resin layers on two surfaces of the film 3 may vary in thickness depending on the product application. The total thickness of the resin layers is 5% to 80% of the overall thickness. The molded shape, that is, the shape of the punch 2 ranges from about 5 mm×5 mm to 400 mm×400 mm. The molding depth ranges from 0.5 mm to 30 mm.

The end of the punch 2 has a tapered portion 10 that is set by dividing the clearance between the die 1 and the punch 2 by the molding depth. The molded shape of a product and the surface of the punch 2 match with each other. An operation control unit 30 controls the operations of the drag Do, the cope Up, the punch 2, the pad 5, and so on.

Figure 6:
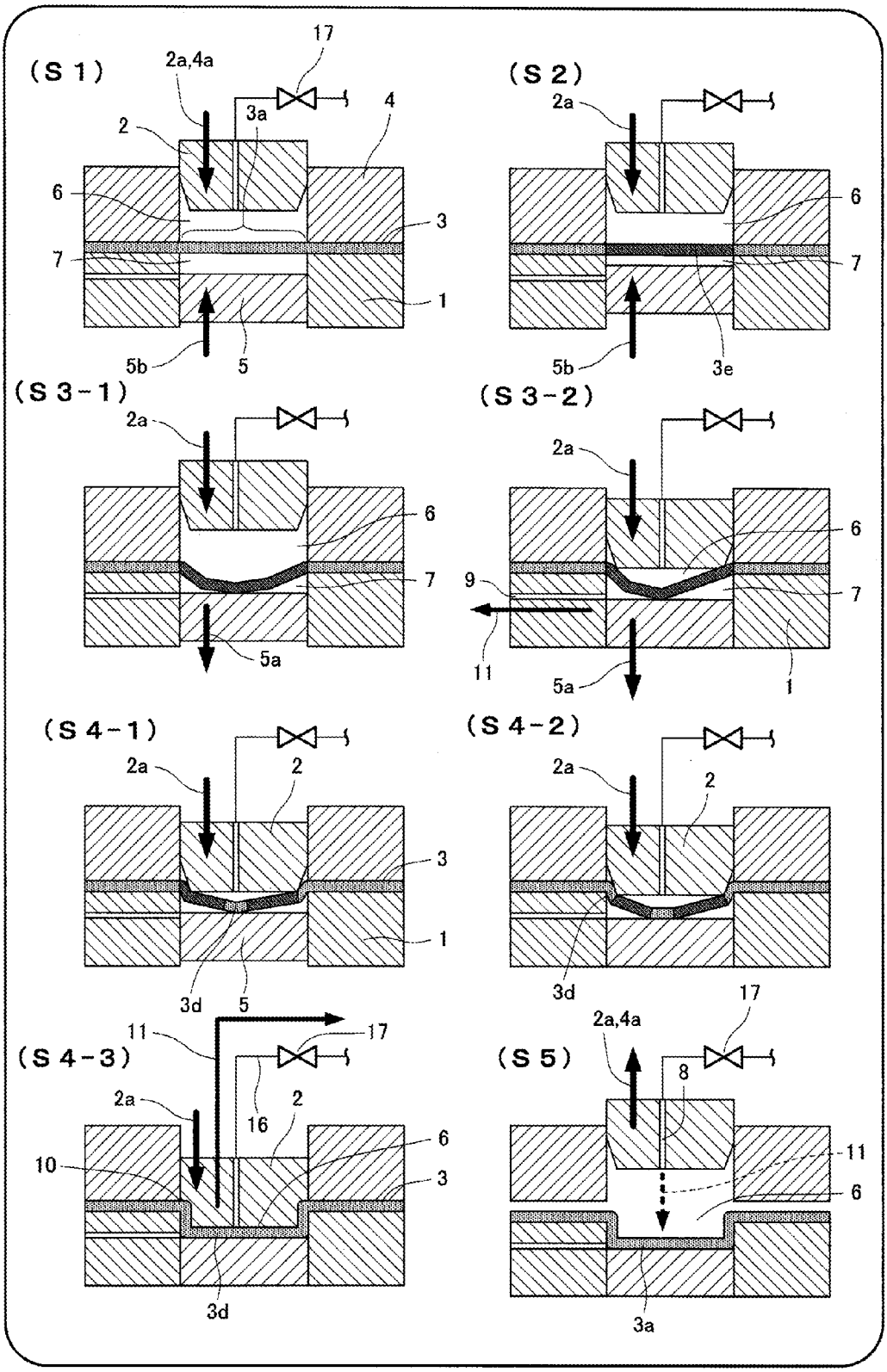
FIG. 6 is a molding process drawing of the molding apparatus according to the second embodiment.

Steps S1, S2, S3-1, S3-2, S4-1, S4-2, S4-3, and S5 in FIG. 6 show a molding process performed by the operation control unit 30 according to the second embodiment.

Figure 7:
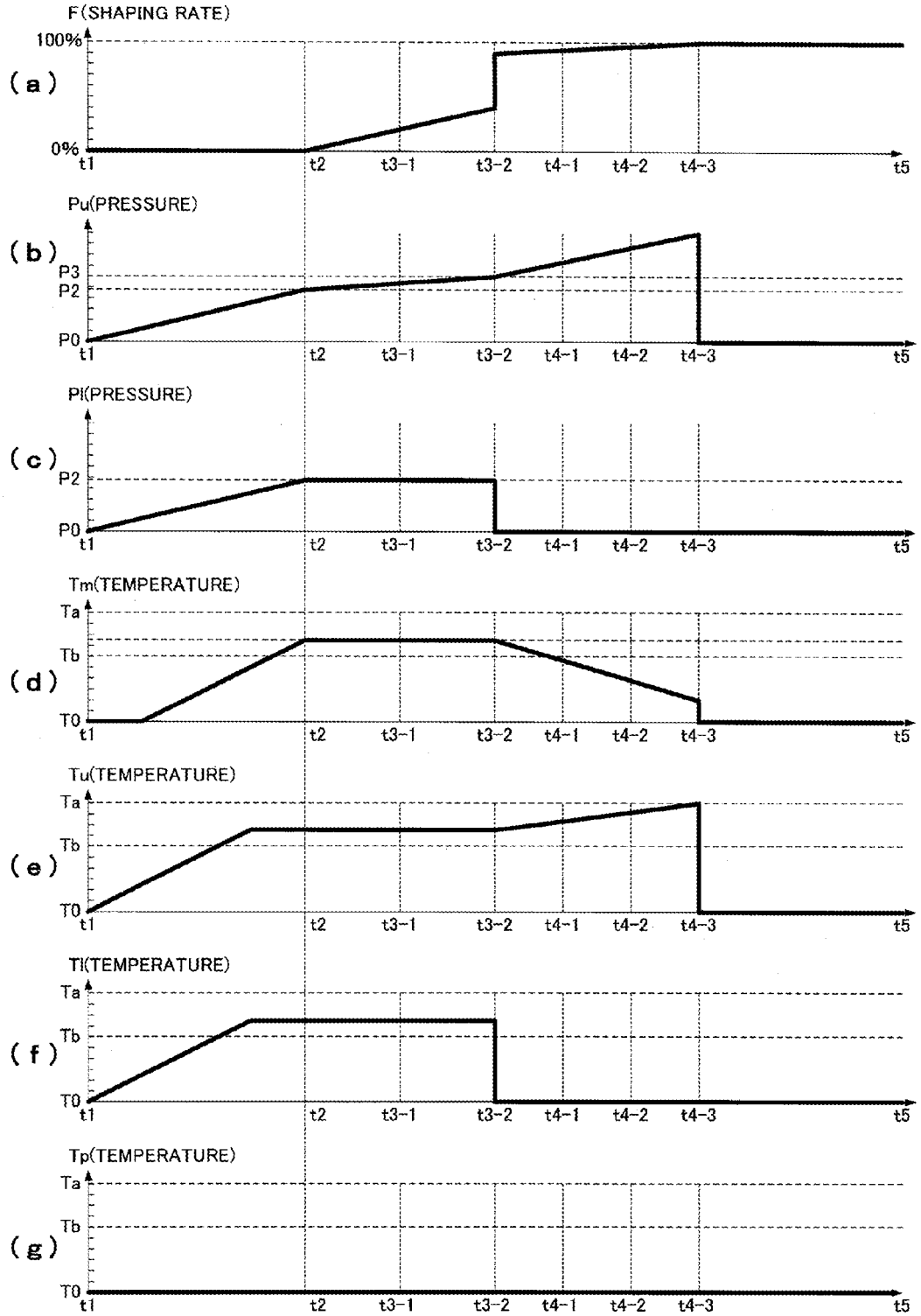
FIG. 7 is a change chart showing a pressure, a temperature, and so on of each part in the steps of the second embodiment.

FIGS. 7(*a*) to 7(*g*) show time variations in the shaping rate, pressure, and temperature of a molded article according to the present embodiment. Marks in FIGS. 7(*a*) to 7(*g*) are identical to those of FIG. 3 of the first embodiment.

FIGS. 7(*a*) to 7(*g*) show the following times:

time t1: the completion of enclosed space formation in step S1 of FIG. 6 time t2: the completion of temperature increase in step S2 of FIG. 6 time t3-1: the completion of first molding in step S3-1 of FIG. 6 time t3-2: the completion of first molding in step S3-2 of FIG. 6 time t4-1: the completion of second molding in step S4-1 of FIG. 6 time t4-2: the completion of second molding in step S4-2 of FIG. 6 time t4-3: the completion of second molding in step S4-3 of FIG. 6 time t5: the completion of return in step S5 of FIG. 6

Referring to FIGS. 6 and 7, the operations of the present embodiment and effects on the molded portion 3*a* will be specifically described below.

In the enclosed space formation of step S1, first, the punch 2 moves down along an arrow 2*a*, the plate 4 moves down along an arrow 4*a*, and the pad 5 moves up along an arrow 5*b* with the closed valve 17, forming a first enclosed space 6 surrounded by the punch 2, the plate 4, and the film 3 and a second enclosed space 7 surrounded by the die 1, the pad 5, and the film 3.

In the temperature rise of step S2, the punch 2 moves down along the arrow 2*a* and the pad 5 moves up along the arrow 5*b*, simultaneously compressing the first enclosed space 6 and the second enclosed space 7 to an equal pressure (Pu=Pl=P2). At this point, high speed compression can prevent thermal diffusion around the enclosed spaces. Moreover, the temperatures of the first and second enclosed spaces 6 and 7 are increased by adiabatic compression to bring a molded portion 3*a* into an elevated temperature state 3*e*. For example, in the case of molding in an atmosphere of air with a specific heat ratio of 1.4, a temperature increase from 27° C. (300 K) to 127° C. (400 K) in an enclosed space that is 100 mm in length, 100 mm in width, and 20 mm in depth (a volume of $20\times10^4$ $mm^3$) may require a compressibility of about 49% (a compressed volume is $9.74\times10^4$ $mm^3$) based on an expression "thermodynamic rule: T [K; temperature]×V [$mm^3$; volume]^ (γ [specific heat ratio]−1) =constant=39585.24 [K×$mm^3$]".

In the first molding of step S3-1, the punch 2 moves down along the arrow 2*a* to press the first enclosed space 6 (Pu:P2→P3); meanwhile, the pad 5 is moved down along an arrow 5*a* while keeping the volume and pressure of the second enclosed space 7. A pressure Pu in the first enclosed space 6 gradually increases while a pressure Pl in the second enclosed space 7 is kept at a constant value P2, gradually increasing a pressure difference to start primary molding.

Furthermore, in the first molding, the punch 2 moves down along the arrow 2*a* and the pad 5 moves down along the arrow 5*a* to the molding depth as illustrated in step S3-2. At this point, air flows along an arrow 11 from the second hole 9 provided on the side of the die 1 and the pad 5 stops moving down along the arrow 5*a*. Since the pressure Pl of the second enclosed space 7 reaches P0 (atmospheric pressure), a pressure difference between the first and second enclosed spaces 6 and 7 rapidly increases, accelerating primary molding.

Hence, the film 3 raised at a temperature T2 (Ta>T2>Tb) at time t3-1 in FIG. 7(*d*) comes into contact with the punch 2, the die 1, and the pad 5 having lower temperatures at time T4, and then the film 3 is cooled to a temperature T0.

In the second molding of step S4-1, the punch 2 further moves down along the arrow 2*a*, so that the film 3 is punched by the punch 2, the die 1, and the pad 5. As in the first embodiment, the punch 2, the die 1, and the pad 5 at this point are kept cooled (temperature T0) as shown in FIG. 7(*g*). Thus, the film 3 at the temperature T2 (Ta>T2>Tb) at time "t3-1" in FIG. 7(*d*) comes into contact with the punch 2, the die 1, and the pad 5 having lower temperatures at time "t4-1", and then the film 3 is brought into a cooled state 3*d* at the temperature T0.

At time t4-1, primary molding is insufficient on a corner (the right side in FIG. 6). Thus, the corner comes into contact with the punch 2 prior to a linear part (the left side in FIG. 6) and is brought into the cooled state 3*d*. Moreover, the molded portion 3*a* expanded in contact with the pad 5 by primary molding is also cooled.

In the second molding, as illustrated in step S4-2, the punch 2 continuously moving down along the arrow 2*a* comes into contact with the linear part (the left side in FIG. 6) to cool the linear part.

Furthermore, in the second molding, as illustrated in step S4-3, when the punch 2 moves down to the bottom dead center along the arrow 2*a*, the valve 17 is opened. Hence, high temperature and high pressure air in the first enclosed space 6 flows to the outside along an arrow 11*a* through a pipe 16, so that the film 3 satisfies Tm=T0 (cooled). In this case, the tapered portion 10 on the end of the punch 2 is covered with the material, thereby accelerating cooling.

Finally, in the return of step S5, the valve 17 is opened, the punch 2 moves up along an arrow 2*b* to the point of origin, and the plate 4 moves up along an arrow 4*b* to the point of origin. As the punch 2 moves up along the arrow 2*b*, the first enclosed space 6 is increased in volume and is reduced in pressure, which may cause a dent in the molded portion 3*a*. At this point, a dent may be prevented by optionally supplying air into the first enclosed space 6 from the first hole 8 along an arrow 11*b* to increase a pressure.

This configuration can shorten the steps of the series of molding operations, achieving a shorter molding cycle. First, the adiabatic compression of the first and second enclosed spaces 6 and 7 can simultaneously raise the temperatures of the resin layers on the two surfaces of the film 3. Hence, the film 3 in the molded portion 3*a* can be brought into the elevated temperature state 3*e* in a short time, achieving higher extensibility.

Moreover, the tapered portion 10 on the end of the punch 2 brings the overall molded portion 3*a* into contact with the punch 2, accelerating cooling.

Furthermore, a pressure is applied or reduced on the two surfaces of the film 3, thereby easily making a pressure difference. This configuration can effectively suppress variations in production thickness and the occurrence of breaks.

Third Embodiment

FIGS. 8 to 11 illustrate a third embodiment according to the present invention.

The same configurations as in the first embodiment will be indicated by the same reference numerals.

Figure 8:
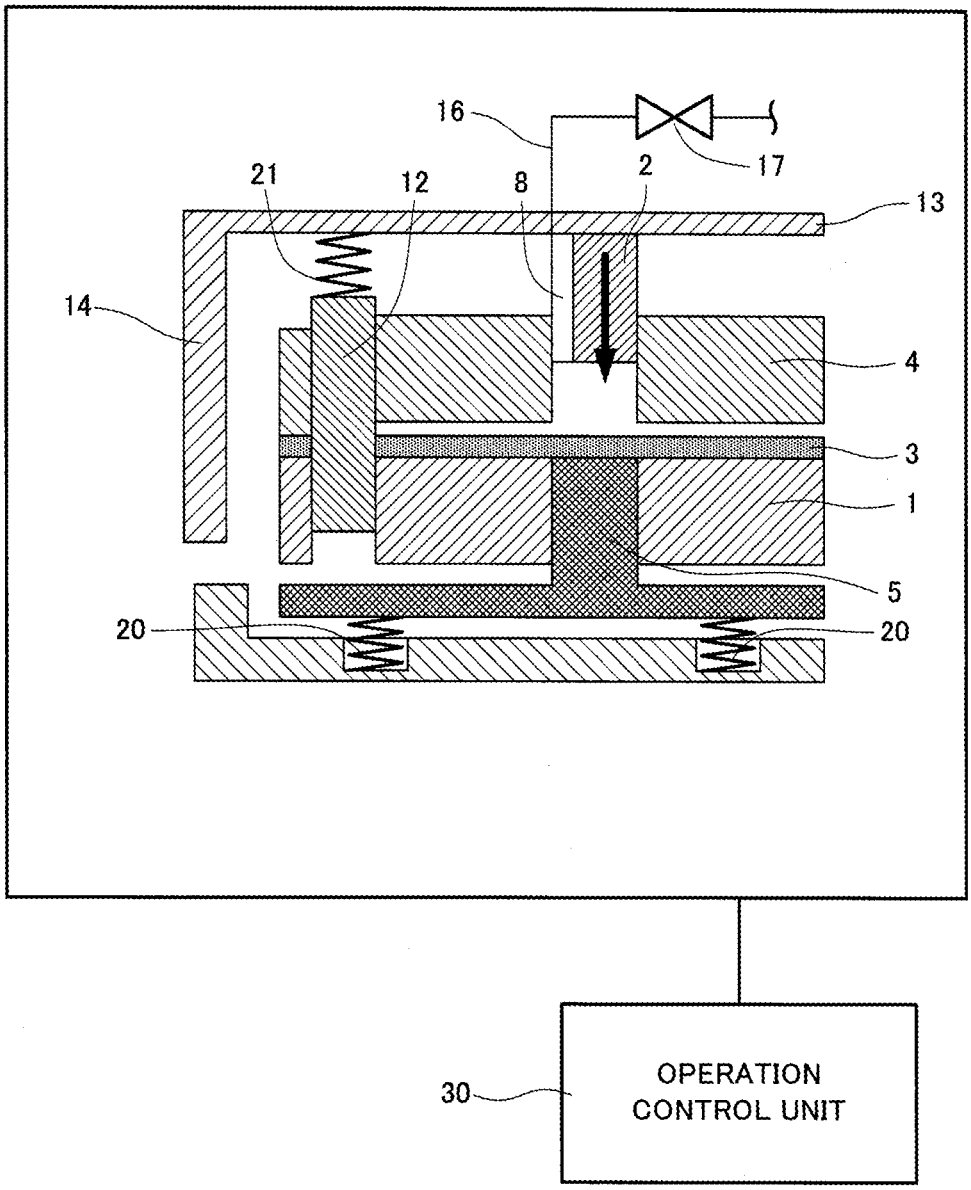
FIG. 8 is a cross-sectional view illustrating a molding apparatus according to a third embodiment, the molding apparatus being used for a method for molding a metal laminate film according to the present invention.
Figure 9:
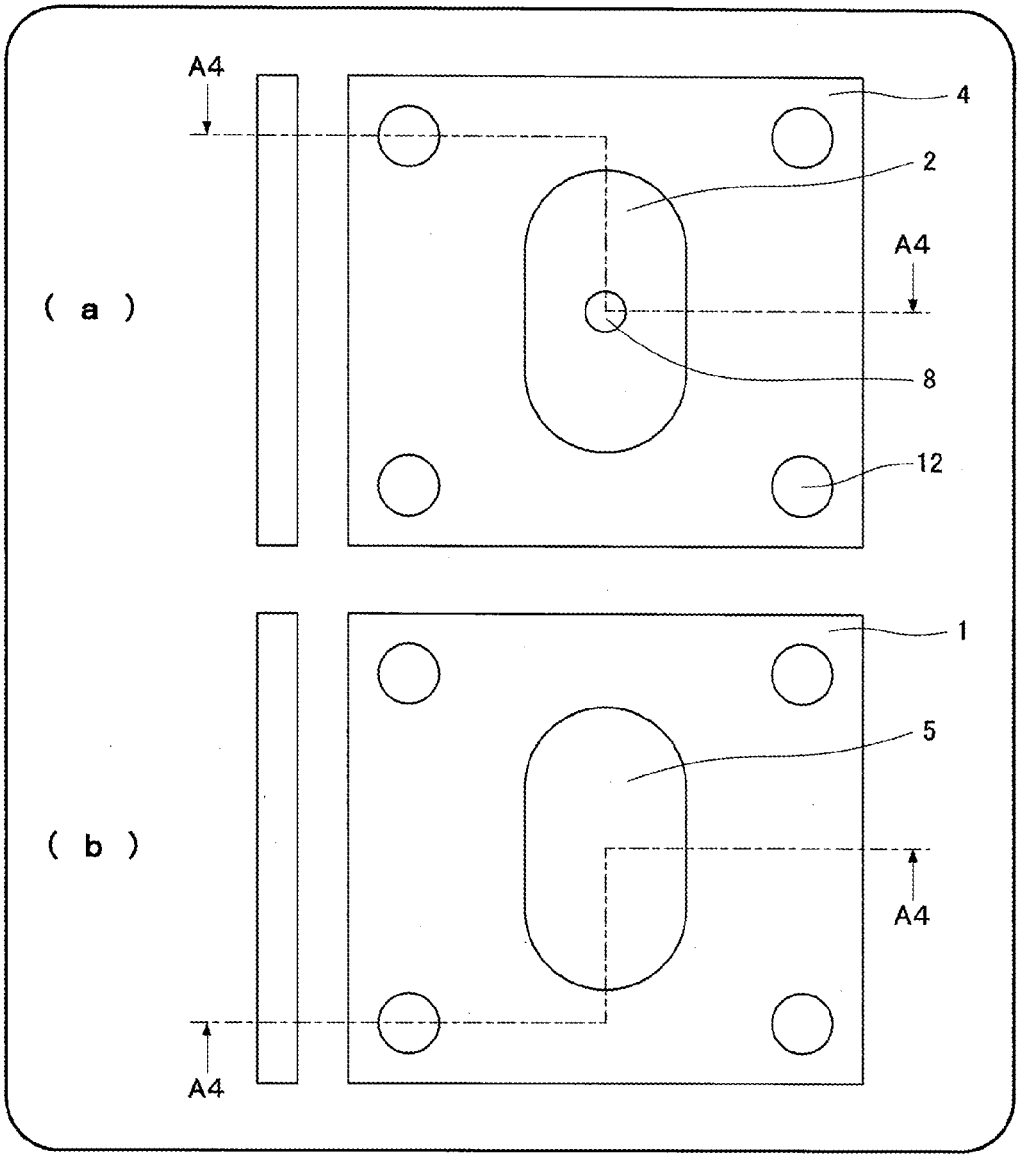
FIG. 9(*a*) is a plan view illustrating the cope of the molding apparatus used for the third embodiment.

FIG. 8 is a cross-sectional view illustrating an apparatus for molding a metal laminate film. In FIG. 8, a cope Up and a drag Do in FIGS. 9(*a*) and 9(*b*) are cut along line A4-A4.

The first and second embodiments are effective for a molded article having a rectangular or complicated shape, and a large ratio of resin layers in a material. In the case of a molded article having a simple shape (e.g., a circle) and a small ratio of resin layers in a material, the occurrence of breaks or wrinkles in a deep molded article can be suppressed by a simple apparatus configuration.

According to the third embodiment, the drag Do includes a die 1 and the cope Up includes a punch 2 as in the second embodiment. The punch 2 and the die 1 are opposed to each other with a film 3 interposed between the punch 2 and the die 1. A plate 4 is attached around the punch 2 of the cope Up while a pad 5 is disposed in the hole of the die 1 of the drag. The punch 2 has a first hole 8. A valve 17 is provided on the first hole 8 via a pipe 16.

Moreover, a pin 12 is operated in synchronization with the operations of the pad 5 and the punch 2, and a cam mechanism 14 is temporarily stopped at the bottom dead center and is returned to the original position as the punch 2 moves up. The cam mechanism 14 is connected to the punch 2 via a cope die set 13 so as to move up or down according to a vertical movement of the punch. The initial position of the pad 5 is set at the same height as the top surface of the die 1. The proximal end of the pin 12 is connected to the cope die set 13 via a buffer spring 21. An operation control unit 30 controls the operations of the drag Do, the cope Up, the punch 2, the pad 5, and so on.

Figure 10:
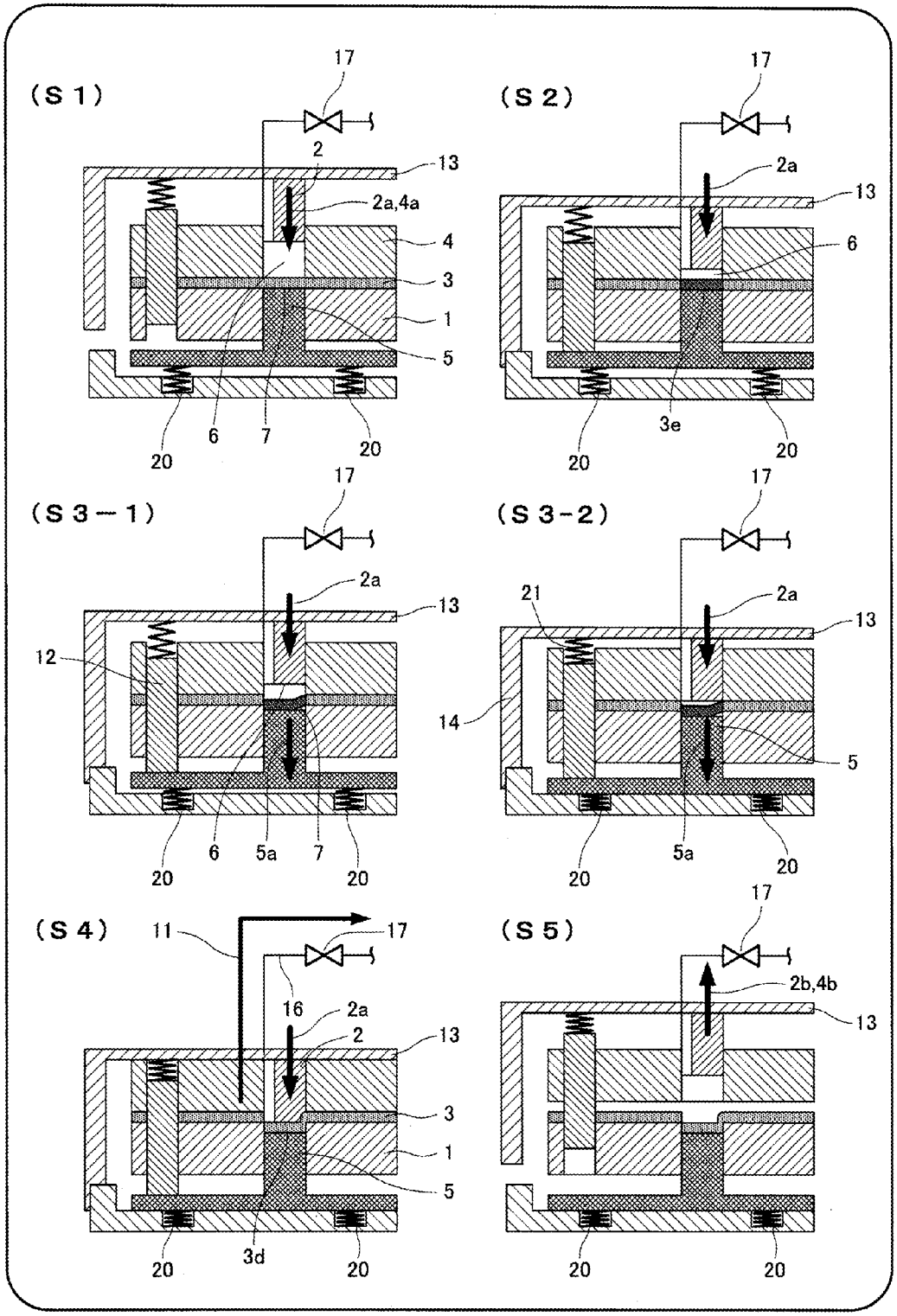
FIG. 10 is a molding process drawing of the molding apparatus according to the third embodiment.

Steps S1, S2, S3-1, S3-2, S4, and S5 in FIG. 10 show a molding process performed by the operation control unit 30 according to the third embodiment.

Figure 11:
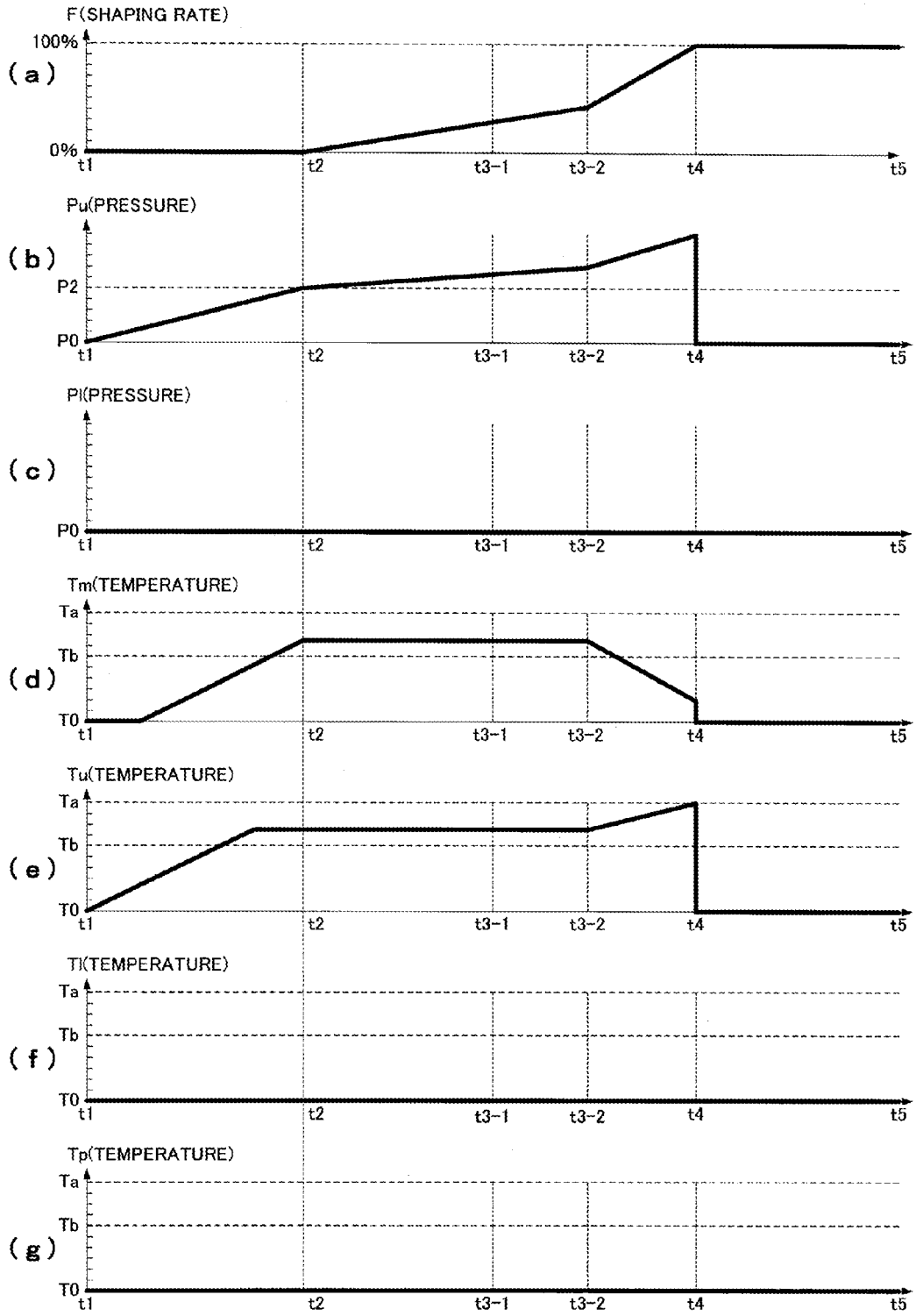
FIG. 11 is a change chart showing a pressure, a temperature, and so on of each part in the steps of the third embodiment.
Figure 12:
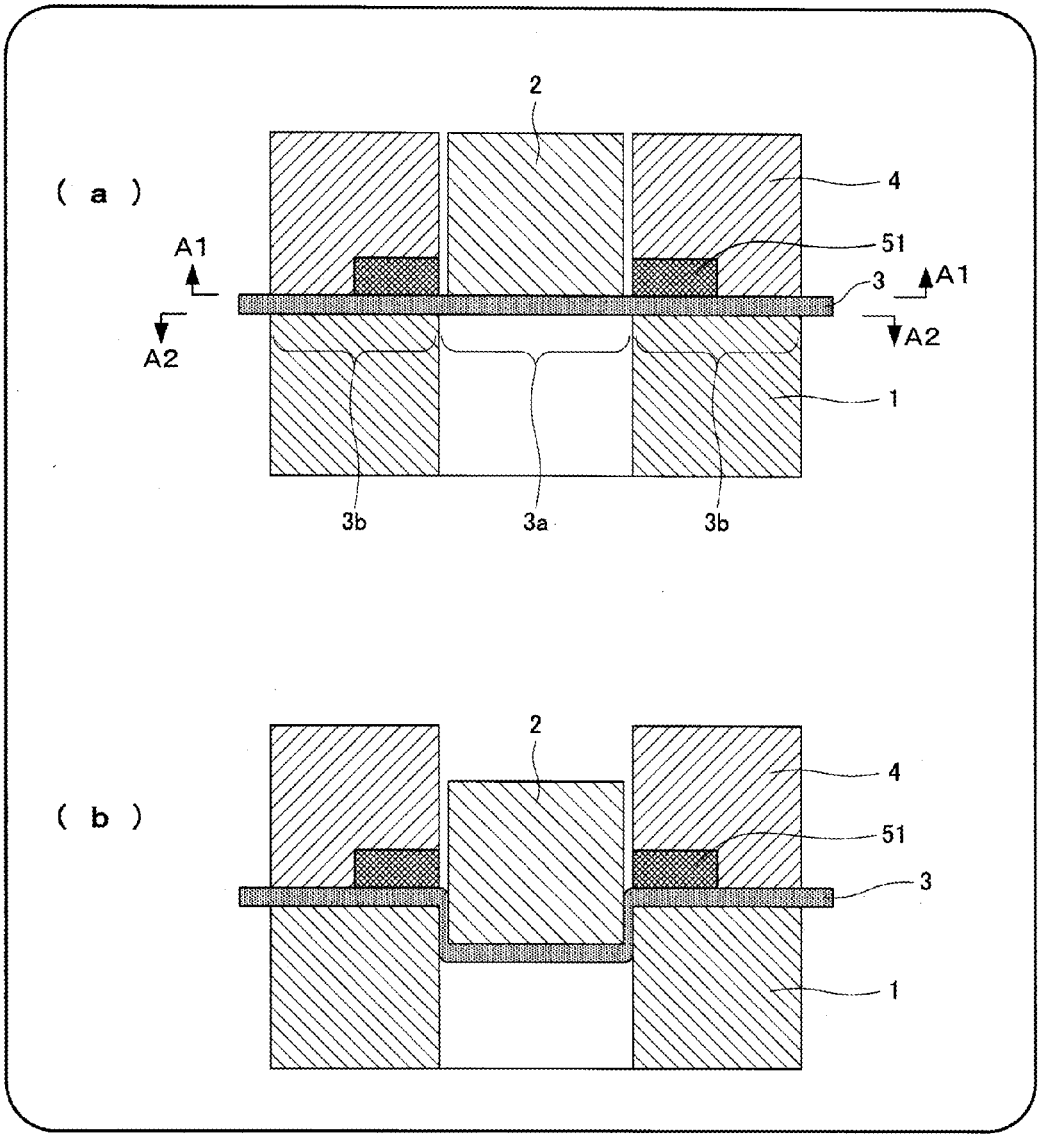
FIG. 12 PRIOR ART
FIG. 12(*a*) is a cross-sectional view illustrating an assembly of a cope and a drag according to a conventional technique.
Figure 13:
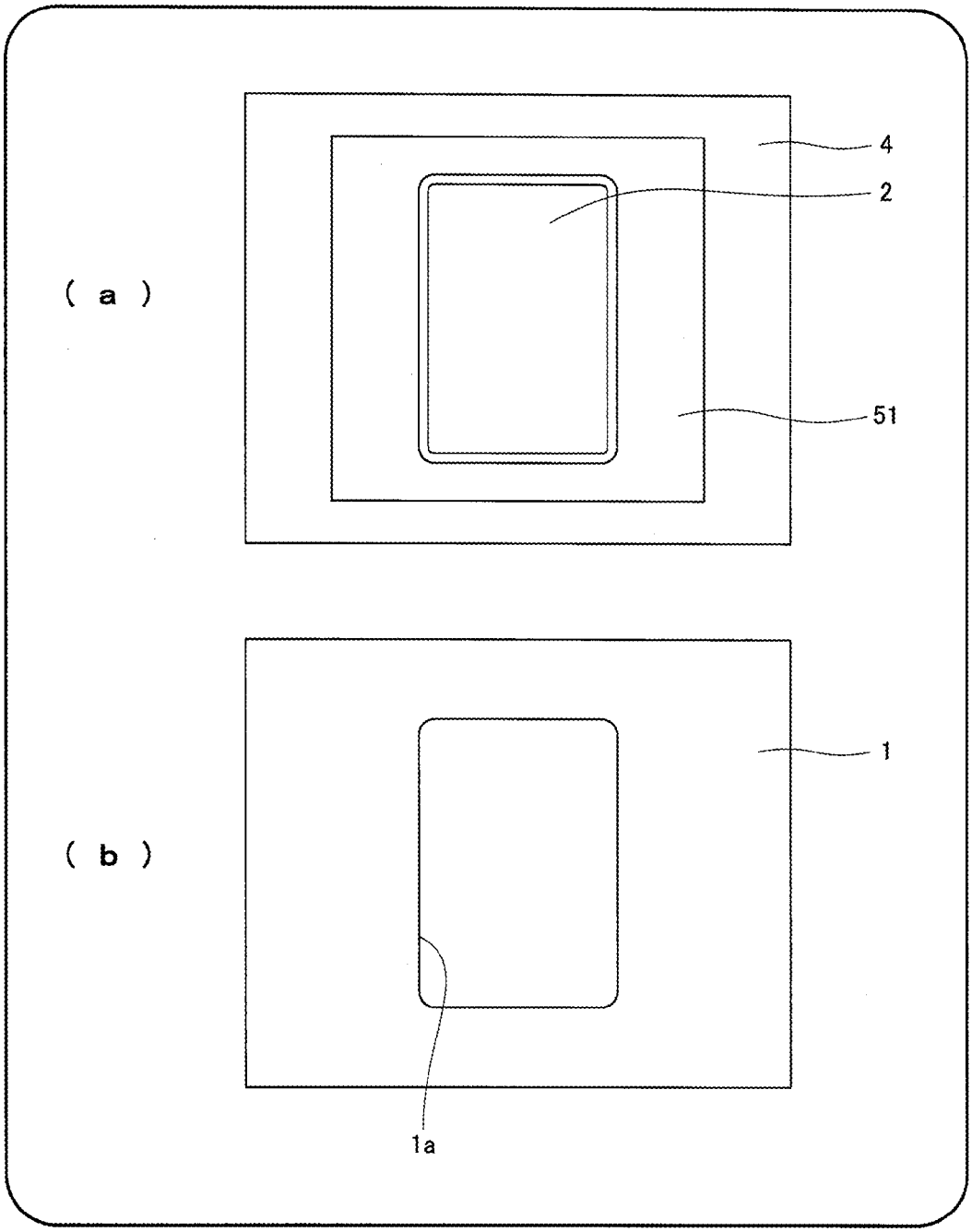
FIG. 13 PRIOR ART
FIG. 13(*a*) is a plan view of the cope taken along line A1-A1 of the conventional technique.

FIGS. 11(*a*) to 11(*g*) show time variations in the shaping rate, pressure, and temperature of a molded article according to the present embodiment. Marks in FIGS. 11(*a*) to 11(*g*) are identical to those of FIG. 3 of the first embodiment.

FIGS. 11(*a*) to 11(*g*) show the following times:

time t1: the completion of enclosed space formation in step S1 of FIG. 10 time t2: the completion of temperature rise in step S2 of FIG. 10 time t3-1: the completion of first molding in step S3-1 of FIG. 10 time t3-1: the completion of first molding in step S3-2 of FIG. 10 time t4: the completion of second molding in step S4 of FIG. 10 time t5: the completion of return in step S5 of FIG. 10

Referring to FIGS. 10 and 11, the operations of the present embodiment and effects on a molded portion 3*a* will be specifically described below.

In the enclosed space formation of step S1, first, the punch 2 moves down along an arrow 2*a* and the plate 4 moves down along an arrow 4*a* with the closed valve 17, forming a first enclosed space 6 surrounded by the punch 2, the plate 4, and the film 3. A second enclosed space 7 surrounded by the die 1, the pad 5, and the film 3 has no volume because no clearance is formed.

In the temperature rise of step S2, the punch 2 further moves down along the arrow 2*a* to press only the first enclosed space 6 (Pu=P2). High speed compression can prevent thermal diffusion around the enclosed spaces. Moreover, the temperature of the first enclosed space 6 is increased by adiabatic compression to bring the molded portion 3*a* into an elevated temperature state 3*e*.

In the first molding of step S3-1, the punch 2 further moves down along the arrow 2*a* to press the first enclosed space 6; meanwhile, the pad 5 pressed upward by springs 20 starts moving down along an arrow 5*a* in response to the force of the pin 12 of the cope against the urging force of the springs 20. At this point, a pressure Pl in the second enclosed space 7 is 0 (vacuum) and the first enclosed space 6 has a pressure Pu (=P2). Thus, primary molding is performed according to a pressure difference P2 between the first enclosed space 6 and the second enclosed space 7 (=Pu−Pl).

Furthermore, in the first molding, the punch 2 moves down along the arrow 2*a* and the pad 5 further moves down along the arrow 5*a* to a molding depth as illustrated in step S3-2. At this point, the primary molding is completed and the pad 5 stops moving down along the arrow 5*a*; meanwhile, the cam mechanism 14 acts on the pad 5 so as to stop the pad 5 at the bottom dead center.

After the primary molding, in the second molding of step S4, the punch 2 continuously moves down along the arrow 2*a*, so that the film 3 is punched by the punch 2, the die 1, and the pad 5. At this point, as shown in FIG. 11(*g*), the punch 2, the die 1, and the pad 5 are kept cooled (temperature T0). Thus, the film 3 in the elevated temperature state 3*e* at a temperature T2 (Ta>T2>Tb) at time t3 in FIG. 11(*d*) comes into contact with the punch 2, the die 1, and the pad 5 having lower temperatures at time t4, and then the film 3 is cooled to the temperature T0.

As in the second embodiment, when the punch 2 reaches the bottom dead center, the valve 17 is opened. Thus, high temperature and high pressure air in the first enclosed space 6 flows out of the apparatus through the pipe 16 along an arrow 11, accelerating cooling on the film 3.

Finally, in the return of step S5, the punch 2 is moved up along an arrow 2*b* to the point of origin with the opened valve 17 while the plate 4 is moved up to the point of origin along an arrow 4*b*.

This configuration requires a drive unit for the operations of the second embodiment but eliminates the need for a drive unit for operating the pad 5, achieving a simple mold structure, higher reliability for the mold and the product, and a shorter molding cycle than in the second embodiment.

In order to prevent further shortening of the molding cycle and variations in molded shape, the punch 2, the die 1, and the pad 5 may be provided with a cooling mechanism including the passage of a heat exchange medium, e.g., cooling water or compressed air.

A rapid temperature change may accelerate material deterioration depending on the kind of the film 3. In this case, a thin thermal barrier for gradually reducing a temperature may be provided in each of the punch 2, the die 1, and the pad 5 so as to provide a mechanism for gradually dissipating heat.

In the foregoing embodiments, air is contained in the first and second enclosed spaces 6 and 7. The first and second enclosed spaces 6 and 7 may contain other kinds of gas, specifically, inert gas such as nitrogen.

The present invention is applicable to a battery package having a complicated shape for protecting an interior part over an extended period or a protective sheet for an electronic component. The present invention is also applicable to the field of manufacturing wrapping materials and containers for agents and food products with metal laminate films.

What is claimed is:

1. A method for molding a metal laminate film, comprising the steps of:

raising a temperature of a molded portion of the metal laminate film to be processed, by moving a punch of a cope to a pad inside a die of a drag to compress gas in a first enclosed space defined by the punch, an inner surface of a plate provided around the punch and the molded portion with an area, of the metal laminate film, surrounding the molded portion interposed between the plate and the die;

first molding including primary molding on the molded portion, the primary molding including the step of moving the punch to the pad to press the gas in the first enclosed space while partially pressing the pad, which has been pressed upward close to the punch by a spring, by means of an end of a pin to move the pad against an urging force of the spring, the pin being connected to the cope at a proximal end of the pin, the primary molding being completed when the pad reaching a molding depth is stopped at a bottom dead center by an action of a cam mechanism; and second molding performed on the molded portion by further moving the punch to the pad while releasing the gas from the first enclosed space to mold the molded portion by means of the punch, the die, and the pad.

* * * * *